343-700 MS AU 256 EX
PTU34 XR 3,972,049

United States Patent [19]
Kaloi

[11] 3,972,049
[45] July 27, 1976

[54] ASYMMETRICALLY FED ELECTRIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[22] Filed: Apr. 24, 1975

[21] Appl. No.: 571,158

[52] U.S. Cl. ..... 343/829; 343/862
[51] Int. Cl.[2] ..... H01Q 1/38
[58] Field of Search ..... 343/846, 854, 829, 862

[56] References Cited
UNITED STATES PATENTS

| | | | |
|---|---|---|---|
| 3,478,362 | 11/1969 | Ricardi et al. | 343/769 |
| 3,803,623 | 4/1974 | Charlot | 343/846 |

*Primary Examiner*—Eli Lieberman
*Attorney, Agent, or Firm*—Richard S. Sciascia; Joseph M. St.Amand

[57] ABSTRACT

An asymmetrically fed electric microstrip dipole antenna consisting of a thin electrically conducting, rectangular-shaped element formed on one surface of a dielectric substrate, the ground plane being on the opposite surface. The length of the element determines the resonant frequency. The feed point is located along the centerline of the antenna length and the input impedance can be varied by moving the feed point along the centerline from the center point to the end of the antenna without affecting the radiation pattern. The antenna bandwidth increases with the width of the element and spacing between the element and ground plane.

11 Claims, 12 Drawing Figures

XY PLANE PLOT
2125.7 MHz Eø

XZ PLANE PLOT
2125.7 MHz Eθ

XY PLANE PLOT
2144.4 MHz Eø

XZ PLANE PLOT
2144.4 MHz Eθ

ASYMMETRICALLY FED ELECTRIC MICROSTRIP DIPOLE ANTENNA

This invention is related to copending U.S. patent applications:

Ser. No. 571,154 for DIAGONALLY FED ELECTRIC MICROSTRIP DIPOLE ANTENNA;
Ser. No. 571,156 for END FED ELECTRIC MICROSTRIP QUADRUPOLE ANTENNA;
Ser. No. 571,155 for COUPLED FED ELECRIC MICROSTRIP DIPOLE ANTENNA;
Ser. No. 571,152 for CORNER FED ELECTRIC MICROSTRIP DIPOLE ANTENNA;
Ser. No. 571,153 for NOTCH FED ELECTRIC MICROSTRIP DIPOLE ANTENNA;
Ser. No. 571,157 for OFFSET FED ELECRIC MICROSTRIP DIPOLE ANTENNA;

all filed together herewith on Apr. 24, 1975 by Cyril M. Kaloi.

BACKGROUND OF THE INVENTION

This invention relates to antennas and more particularly to a low physical profile antenna that can be arrayed to provide near isotropic radiation patterns.

In the past, numerous attempts have been made using stripline antennas to provide an antenna having ruggedness, low physical profile, simplicity, low cost, and conformal arraying capability. However, problems in reproducibility and prohibitive expense made the use of such antennas undesirable. Older type antennas could not be flush mounted on a missile or airfoil surface. Slot type antennas required more cavity space, and standard dipole or monopole antennas could not be flush mounted.

SUMMARY OF THE INVENTION

The present antennna is one of a family of new microstrip antennas. The specific type of microstrip antenna described herein is the "asymetrically fed electric microstrip dipole." Reference is made to the "electric microstrip dipole" instead of simply the "microstrip dipole" to differentiate between two basic types; the first being the electric microstrip type, and the second being the magnetic microstrip type. The asymmetrically fed electric microstrip dipole antenna belongs to the electric microstrip type antenna. The electric microstrip antenna consists essentially of a conducting strip called the radiating element and a conducting ground plane separated by a dielectric substrate. The length of the radiating element is approximately ½ wavelength. The width may be varied depending on the desired electrical characteristics. The conducting ground plane is usually much greater in length and width than the radiating element.

The magnetic microstrip antenna's physical properties are essentially the same as the electric microstrip antenna, except the radiating element is approximately ¼ the wavelength and also one end of the element is grounded to the ground plane.

The thickness of the dielectric substrate in both the electric and magnetic microstrip antenna should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present type of antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since other types of antennas can give better antenna properties above 25 GHz. The antenna of this invention is particularly suited to receive and radiate electromagnetic energy in the 1435–1535 MHz and the 2200—2290 MHz bands. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile. In the present type antenna, it is not necessary to ground the antenna element to the ground plane. Further, the antenna can be easily matched to most practical impedances by varying the location of the feed point along the length of the element.

Advantages of the antenna of this invention over other similar appearing types of microstrip antennas is that the present antenna can be fed very easily from the ground plane side and has a slightly wider bandwidth for the same form factor.

The asymmetrically fed electric microstrip dipole antenna consists of a thin, electrically-conducting, rectangular-shaped element formed on the surface of a dielectric substrate; the ground plane is on the opposite surface of the dielectric substrate and the microstrip antenna element is fed from a coaxial-to-microstrip adapter, with the center pin of the adapter extending through the ground plane and dielectric substrate to the antenna element. The length of the antenna element determines the resonant frequency. The feed point is located along the centerline of the antenna length. While the input impedance will vary as the feed point is moved along the centerline between the antenna center point and the end of the antenna in either direction, the radiation pattern will not be affected by moving the feed point. The antenna bandwidth increases with the width of the element and the spacing (i.e., thickness of dielectric) between the ground plane and the element; the spacing has a somewhat greater effect on the bandwidth than the element width. The radiation pattern changes very little within the bandwidth of operation.

Design equations sufficiently accurate to specify the important design properties of the asymmetrically fed electric dipole antenna are also included below. These design properties are the input impedance, the gain, the bandwidth, the efficiency, the polarization, the radiation pattern, and the antenna element dimensions as a function of the frequency. Calculations have been made using these equations, and typical asymmetrically fed electric microstrip dipole antennas have been built using the calculated results. The design equations for this type antenna and the antennas themselves are new.

DESCRIPTION AND OPERATION

Figure 1A:
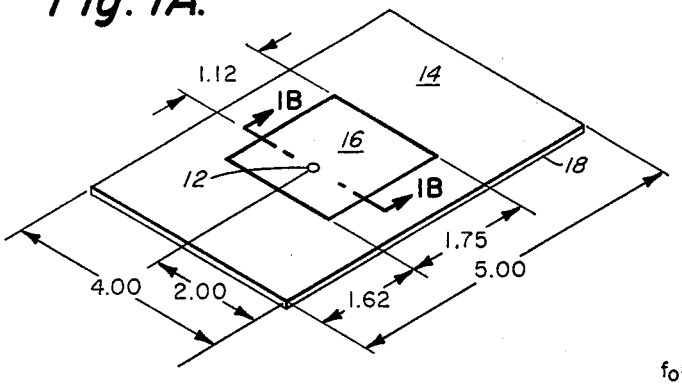
FIG. 1A is an isometric planar view of a typical square asymmetrically fed electric microstrip dipole antenna.
Figure 1B:
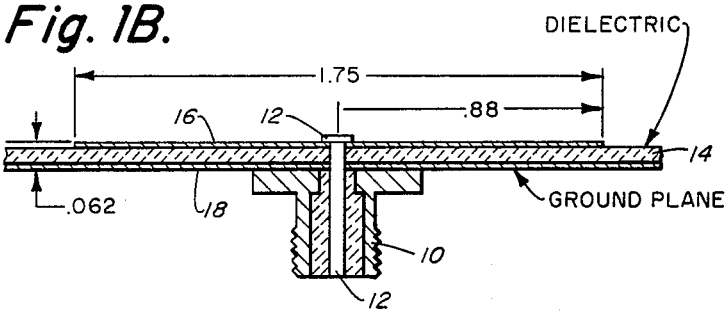
FIG. 1B is a cross-sectional view taken along section line B—B of FIG. 1A.
Figure 2A:
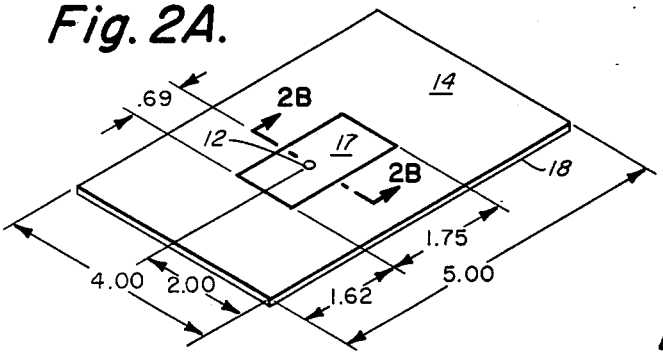
FIG. 2A is an isometric planar view of a typical rectangular asymmetrically fed electric microstrip dipole antenna.
Figure 2B:
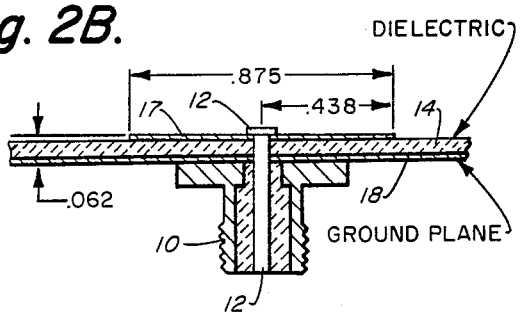
FIG. 2B is a cross-sectional view taken along section line B—B of FIG. 2A.

FIGS. 1A and 1B show a typical square asymmetrically fed electric microstrip dipole antenna of the present invention. FIGS. 2A and 2B show a rectangular asymmetrically fed electric microstrip dipole antenna. The only physical differences in the above antennas are the element width and the location of the feed point. The electrical differences are that the wider antenna element has a slightly greater bandwidth. Two typical antennas are illustrated with the dimensions (in inches) given as shown in FIGS. 1A and 1B, and 2A and 2B, by way of example, and the curves shown in later figures are for the typical antennas illustrated. The antenna is fed from a coaxial-to-microstrip adapter 10, with the center pin 12 of the adapter extending through the dielectric substrate 14 and to the feed point on microstrip element 16 or 17. The microstrip antenna can be fed with most of the different types of coaxial-to-microstrip launchers presently available. The dielectric substrate 14 separates the element 16 or 17 from the ground plane 18 electrically.

Figure 3:
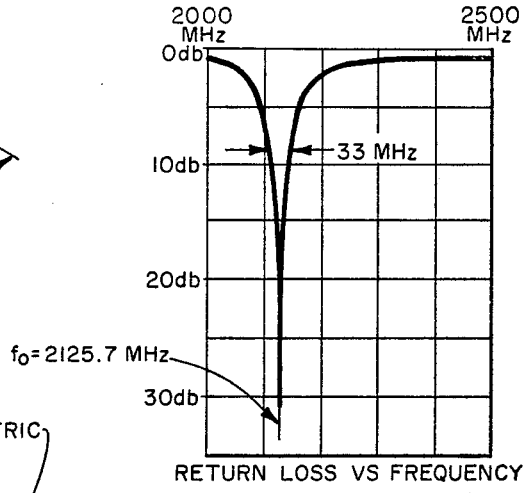
FIG. 3 is a plot showing the return loss versus frequency for a square element antenna having the dimensions shown in FIGS. 1A and 1B.
Figure 4:
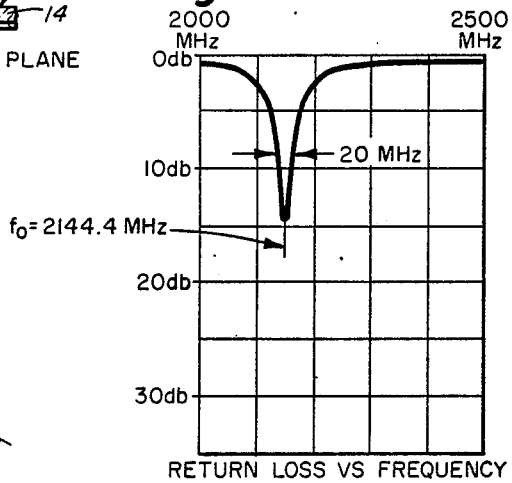
FIG. 4 is a plot showing the return loss versus frequency for a rectangular element antenna having the dimensions as shown in FIGS. 2A and 2B.

FIGS. 3 and 4 show plots of return loss versus frequency (which are indications of bandwidth) for the square element 16 and rectangular element 17, respectively. The square type element is the limit as to how wide the element can be without exciting higher order modes of radiation. With a square element, as in FIGS. 1A and 1B, mode degeneracy may occur if the feed point is not located at the center of the width. The result of mode degeneracy is undesired polarization. The copper losses in the clad material determine how narrow the element can be made. The length of the element determines the resonant frequency of the antenna, about which more will be mentioned later. It is preferred that both the length and the width of the ground plane be at least one wavelength ($\lambda$) in dimension beyond each edge of the element to minimize backlobe radiation.

Figure 5:
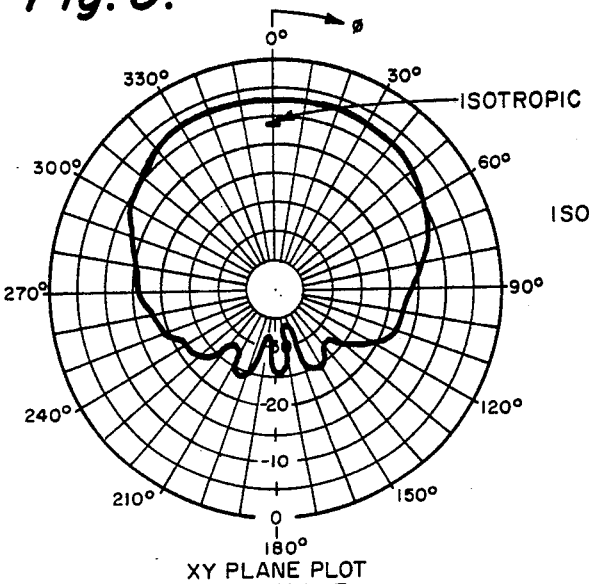
FIG. 5 shown the antenna radiation pattern (XY-Plane plot) for the square element antenna shown in FIGS. 1A and 1B.
Figure 6:
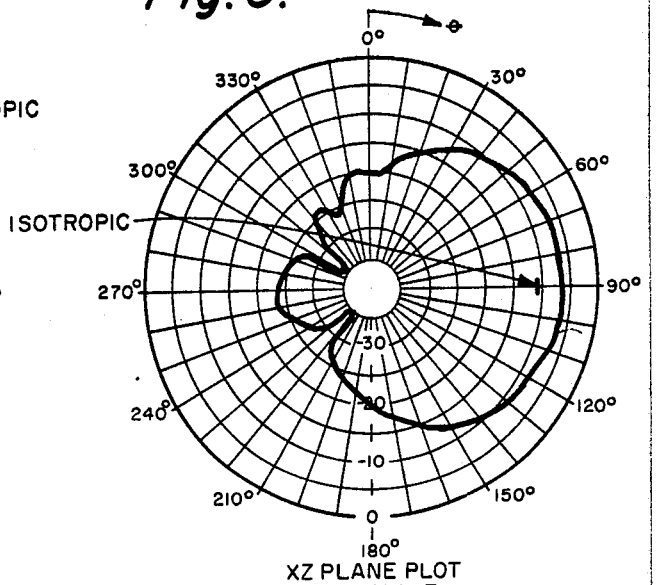
FIG. 6 shows the antenna radiation pattern (XZ-Plane plot) for the square element antenna shown in FIGS. 1A and 1B.
Figure 7:
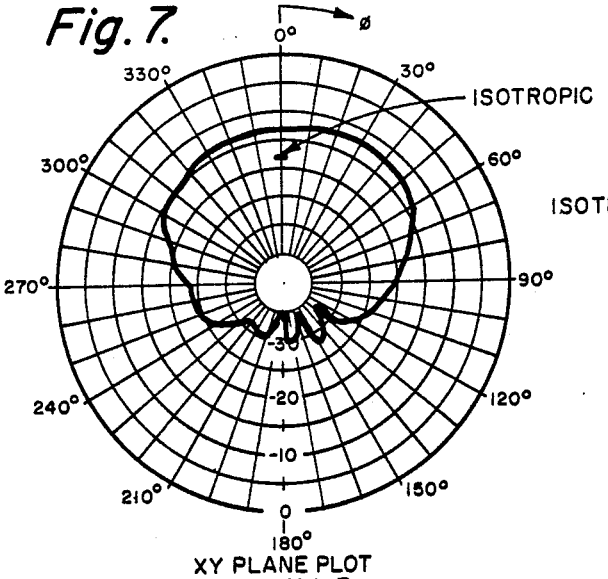
FIG. 7 shows the antenna radiation pattern (XY-Plane plot) for the rectangular element antenna shown in FIGS. 2A and 2B.
Figure 8:
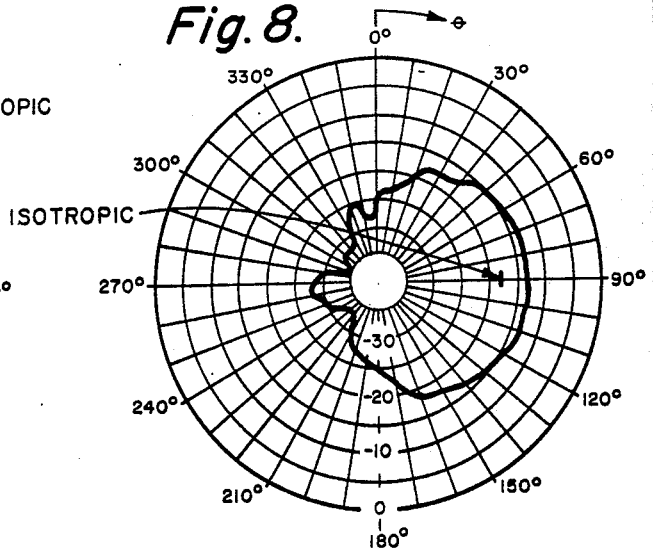
FIG. 8 shows the antenna radiation pattern (XZ-Plane plot) for the rectangular element antenna shown in FIGS. 2A and 2B.

FIGS. 5 and 6 show antenna radiation patterns for the square element of FIGS. 1A and 1B. FIGS. 7 and 8 show similar patterns for the rectangular element of FIGS. 2A and 2B. Only E-plane (XY-plane) plots and H-plane (XZ-plane) plots are shown. Cross-polarization energy is minimal and is therefore not included. The E-plane plot is the measurement made in the plane parallel to the E field (i.e., polarization field). The H-plane plot is the measurement made normal to the E field. The H-plane plots show that the rectangular element has a narrower beam width than the square element. Note that the beam width narrowing effects are due to ground plane effects.

If the antenna is fed at the end of the element length on the centerline, a matching transmission line will be required since the input impedance will be very high for most practical microstrip antennas. The antenna when fed in this manner becomes an end fed antenna.

Since the design equations for this type of antenna are new, pertinent design equations that are sufficient to characterize this type of antenna are therefore presented.

DESIGN EQUATIONS

To a system designer, the properties of an antenna most often required are the input impedance, gain, bandwidth, efficiency, polarization, and radiation pattern. The antenna designer needs to know the above-mentioned properties and also the antenna element dimension as a function of frequency.

Figure 9:
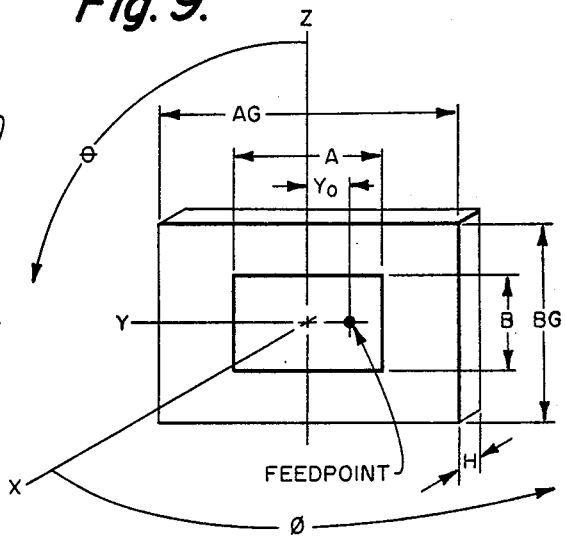
FIG. 9 illustrates the alignment coordinate system used for the asymetrically fed electric microstrip dipole antenna.

The coordinate system used and the alignment of the antenna element within this coordinate system are shown in FIG. 9. The coordinate system is in accordance with the IRIG Standards and the alignment of the antenna element was made to coincide with the actual antenna patterns that were shown earlier. The B dimension is the width of the antenna element. The A dimension is the length of the antenna element. The H dimension is the height of the antenna element above the ground plane and also the thickness of the dielectric. The AG dimension and the BG dimension are the length and the width of the ground plane, respectively. The $Y_o$ dimension is the location of the feed point measured from the center of the antenna element. The angles $\theta$ and $\phi$ are measured per IRIG Standards. The above parameters are measured in inches and degrees.

Antenna Element Dimension

The equation for determining the length of the antenna element is given by $$A = [1.18 \times 10^{10} - F \times 4 \times H \times \sqrt{\epsilon}]/[2 \times F \times \sqrt{1 + 0.61 \times (\epsilon - 1) \times (B/H)^{0.1165}}] \quad (1)$$

where $x$ = indicates multiplication $F$ = center frequency (Hz)

$\epsilon$ = the dielectric constant of the substrate (no units).

In most practical applications, $B$, $F$, $H$ and $\epsilon$ are usualy given. However, it is sometimes desirable to specify $B$ as a function of $A$ as in a square element. As seen from equation (1), a closed form solution is not possible for the square element. However, numberical solution can be accomplished by using Newton's Method of successive approximation (see U.S. National Bureau of Standards, Handbook Mathematical Functions, Applied Mathematics Series 55, Washington, D.C., GPO, Nov., 1964) for solving equation (1) in terms of $B$ when $B$ is a function of $A$. Equation (1) is obtained by fitting curves to Sobol's equation (Sobol, H. "Extending IC Technology to Microwave Equipment," ELECTRONICS, Vol. 40, No. 6, (20 Mar, 1967), pp. 112–124). The modification was needed to account for end effects when the microstrip transmission line is used as an antenna element. Sobol obtained his equation by fitting curves to Wheeler's conformal mapping analysis (Wheeler, H. "Transmission Line Propertiees of Parallel Strips Separated by a Dielectric Sheet," IEEE TRANSACTIONS, Microwave Theory Technique Vol MTT-13, No. 2, Mar., 1965, pp. 172–185).

Radiation Pattern

The radiation patterns for the $E_\theta$ field and the $E_\phi$ field are usually power patterns, i.e., $|E_\theta|^2$ and $|E_\phi|^2$, respectively.

The electric field for the asymmetrically fed dipole is given by $$E\theta = \frac{jI_m Z_o e^{-jkr}}{2\lambda r}[U \times \cos\phi + T \times \sin\theta] \quad (2)$$

and $$E\phi = \frac{jI_m Z_o e^{-jkr}}{2\lambda r}[U \times \sin\phi \cos\theta] \quad (3)$$

where $U = (U2 - 3)/U5$ $T = (T3 - T4)/T8$ $U2 = P \sin(A \times P/2) \cos(k \times A \times \sin\theta \sin\phi/2)$ $U3 = k \sin\theta \sin\phi \cos(A \times P/2) \sin(k \times A \times \sin\theta \sin\phi/2)$ $U5 = (P^2 - k^2 \sin^2\theta \sin^2\phi)$ $T3 = P \sin(P \times B/2) \cos(k \times B \times \cos\theta/2)$ $T4 = k \cos\theta \cos(P \times B/2) \sin(k \times B \times \cos\theta/2)$ $T8 = (P^2 - k^2 \cos^2\theta)$ $\lambda$ = free space wave length (inches) $\lambda_g$ = waveguide wavelength (inches)

and $\lambda_g \approx 2 \times A + (4 \times H \quad \sqrt{\epsilon})$ $j = (\sqrt{-1})$ $$Z_o = \frac{377 \times H}{\sqrt{\epsilon} \times B \times [1 + 1.735(\epsilon^{-0.0724})(H/B)^{0.836}]}$$

Therefore $$|E_\phi|^2 = \frac{I_m^2 Z_o^2}{4\lambda^2 r^2}[U \times \cos\phi + T \times \sin\theta]^2 \quad (4)$$

and $$|E_\theta|^2 = \frac{I_m^2 Z_o^2}{4\lambda^2 r^2}[U \times \sin\phi \cos\theta]^2 \quad (5)$$

Since the gain of the antenna will be determined later, only relative power amplitude as a function of the aspect angles is necessary. Therefore, the above equations may be written as $$|E_\phi|^2 = \text{Const} \times [U \times \cos\phi + T \times \sin\theta]^2 \quad (6)$$

and $$|E_\theta|^2 = \text{Const} \times [U \times \sin\phi \cos\theta]^2 \quad (7)$$

The above equations for the radiation patterns are approximate since they do not account for the ground plane effects. Instead, it is assumed that the energy emanates from the center and radiates into a hemisphere only. This assumption, although oversimplified, facilitates the calculation of the remaining properties of the antenna. However, a more accurate computation of the radiation pattern can be made.

Polarization

The polarization of the asymmetrically fed microstrip antenna is linear along the Y axis when the B dimension is less than the A dimension and also when the feed point is located dead center in the B dimension. If the feed point is not located dead center, cross polarizations can occur.

Efficiency

Calculation of the efficiency entails calculating several other properties of the antenna. To begin with, the time average Poynting Vector is given by $$P_{av} = R_e(\bar{E} \times \overline{H^*})/2 = (|E_\theta|^2 + |E_\phi|^2)/(2 \times Z_o) \quad (8)$$

where

* indicates the complex conjugate when used in the exponent $R_e$ means the real part and $X$ indicates the vector cross product.

$$P_{av} = \frac{Z_o I_m^2}{8\lambda^2 r^2}[U^2 \times \cos^2\phi + 2 \times T \times U \times \sin\theta \cos\phi + T^2 \times \sin^2\theta + U^2 \times \sin^2\phi \cos^2\theta] \quad (9)$$

$I_m$ = maximum current (amps)

$$P = \frac{2\pi}{\lambda_g}, \; k = \frac{2\pi}{\lambda}$$

$e$ = base of the natural log $r$ = the range between the antenna and an arbitrary point in space (inches)

$Z_0$ = characteristic impedance of the element (ohms) and $Z_0$ is given by

The radiation intensity, K, is the power per unit solid angle radiated in a given direction and is given by $$K = r^2 \times P_{av} \quad (10)$$

The radiated power, W, is given by $$W = \int_0^{\pi} \int_{-\frac{\pi}{2}}^{\frac{\pi}{2}} K \times \sin\theta \, d\theta \, d\phi \quad (11)$$

The radiation resistance, $R_a$, is given by $$R_a = \frac{W}{I_{eff}^2} \tag{12}$$

where $$I_{eff} = \frac{I_m}{\sqrt{2}} \tag{13}$$

therefore $$R_a = \frac{2 \times W}{I_m^2} \tag{14}$$

$$R_a = \frac{Z_o}{4 \times \lambda^2} \int_0^{\pi} \int_{-\frac{\pi}{2}}^{\frac{\pi}{2}} [U^2 \times \cos^2 \phi + 2 \times T \times U \times \sin \theta \cos \phi + T^2 \times \sin^2 \theta + U^2 \times \sin^2 \phi \cos^2 \theta] \sin \theta \, d\theta \, d\phi \tag{15}$$

Numerical integration of the above equation can be easily accomplished using Simpson's Rule. The efficiency of the antenna can be determined from the ratio of the Q (quality factor) due to the radiation resistance and the Q due to all the losses in the microstrip circuit. The Q due to the radiation resistance, $Q_R$, is given by $$Q_R = (\omega \times L \times A)/(2 \times R_a)$$

where $\omega = 2\pi F$ and $L$ is the inductance of a parallel-plane transmission line and can be found by using Maxwell's Emf equation, where it can be shown that $$L = Z_0/(F \times \lambda_g)$$

and $$\lambda_g \approx 2 \times A + (4 \times H/\sqrt{\epsilon})$$

The $Q$ due to the radiation resistance, $Q_R$, is therefore given by $$Q_R = (\pi \times Z_o \times A)/(\lambda_g \times R_a)$$

The $Q$ due to the copper losses, $Q_c$, is similarly determined.

$$Q_c = (\omega \times L \times A)/(2 \times R_c)$$

where $R_c$ is the equivalent internal resistance of the conductor. Since the ground plane and the element are made of copper, the total internal resistance is twice $R_c$. $R_c$ is given by $$R_c = (R_s \times A/B) \text{ (ohm)}$$

where $R_s$ is the surface resistivity and is given by $$R_s = \sqrt{(\pi \times F \times \mu)/\sigma} \text{ (ohm)}$$

where $\sigma$ is the conductivity in mho/in. for copper and $\mu$ is the permeability in henry/in. $\sigma$ and $\mu$ are given by $$\sigma = 0.147 \times 10^7, \mu = 0.0319 \times 10^{-6}$$

therefore $$Q_c = (\pi \times Z_o \times B)/(\lambda_g \times R_s)$$

The loss due to the dielectric is usually specified as the loss tangent, $\delta$. The $Q$, resulting from this loss, is given by $$Q_D = 1/\delta$$

The total $Q$ of the microstrip antenna is given by $$Q_T = \frac{1}{\frac{1}{Q_R} + \frac{1}{Q_c} + \frac{1}{Q_D}}$$

The efficiency of the microstrip antenna is given by $$eff = Q_T/Q_R$$

Bandwidth

The bandwidth of the microstrip antenna at the half power point is given by $$\Delta f = F/Q_T$$

The foregoing calculations of $Q$ hold if the height, $H$, of the element above the ground plane is a small part of a waveguide wavelenth, $\lambda_g$, where the waveguide wavelength is given by $$\lambda_g \approx 2 \times A + (4 \times H/\sqrt{\epsilon})$$

If $H$ is a significant part of $\lambda_g$, a second mode of radiation known as the monopole mode begins to add to the microstrip mode of radiation. This additional radiation is not undesirable but changes the values of the different antenna parameters.

Gain

The directive gain is usually defined (H. Jasik, ed., Antenna, Engineering Handbook, New York McGraw-Hill Book Co., Inc., 1961, p.3) as the ratio of the maximum radiation intensity in a given direction to the total power radiated per $4\pi$ steradians and is given by $$D = K_{max}/(W/4\pi)$$

The maximum value of radiation intensity, $K$, occurs when $O \times 90°$ and $\phi = 0°$. Evaluating $K$ at these values of $\theta$ and $\phi$, we have $$K\Big|_{\substack{\theta = 90° \\ \phi = 0°}} = K_{max}$$

$$K_{max} = \frac{Z_o I_m^2}{8\lambda^2 p^2} [\sin (AP/2) + \sin (BP/2)]^2$$

since $$W = (R_a \times I_m^2)/2$$

$$D = \frac{Z_o \times \pi}{R_a \times \lambda^2 \times P^2} [\sin (AP/2) + \sin (BP/2)]^2$$

and for $A = B$ $$D = (4 \times Z_o \times A^2)/(R_a \times \lambda^2 \times \pi)$$

Typical calculated directive gains are 5.7 db. The gain of the antenna is given by $$G = D \times \text{efficiency}$$

Input Impedance

To determine the input impedance at any point along the asymmetrically fed microstrip antenna, the current distribution may be assumed to be sinusoidal. Furthermore, at resonance the input reactance at that point is zero. Therefore, the input resistance is given by $$R_{in} = \frac{2 \times Z_o^2 \times \sin^2 (2\pi\, y_o/\lambda_g)}{R_t}$$

Where $R_t$ is the equivalent resistance due to the radiation resistance plus the total internal resistance or $$R_t = R_a + 2R_c$$

The equivalent resistance due to the dielectric losses may be neglected.

The foregoing equations have been developed to explain the performance of the microstrip antenna radiators discussed herein and are considered basic and of great importance to the design of antennas in the future.

Typical anttennas have been built using the above equations and the calculated results are in good agreement with test results.

Figure 10:
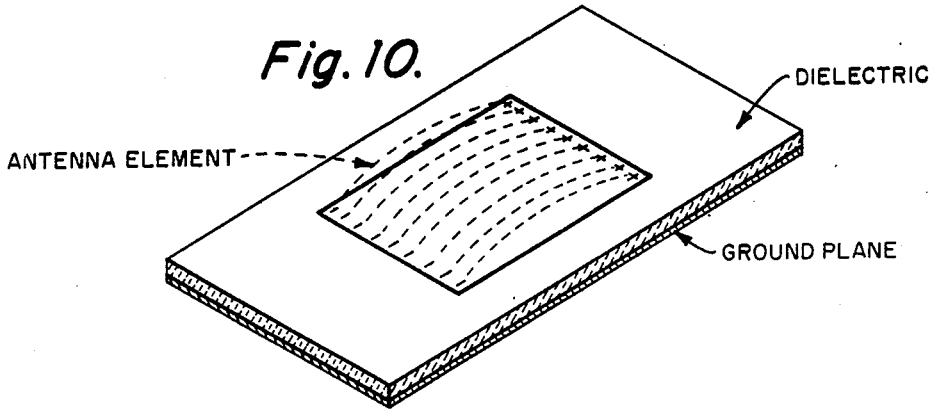
FIG. 10 illustrates the general configuration of the near field radiation when fed along the centerline of the antenna.

The near field radiation configuration, when the antenna is fed at the center of the width of the antenna and where the length of the element is approximately ½ the waveguide wavelength ($\lambda_g$), is shown in FIG. 10. If the feed point is moved off the center of the width, the field configuration will change to include cross-polarization radiation.

I claim:

1. An asymmetrically fed electric microstrip dipole antenna having low physical profile and conformal arraying capability, comprising:

a. a thin ground plane conductor;

b. a thin rectangular radiating element spaced from said ground plane;

c. said radiating element being electrically separated from said ground plane by a dielectric substrate;

d. said radiating element having a feed point located along the centerline of the length thereof;

e. said radiating element being fed from a coaxial-to-microstrip adapter, the center pin of said adapter extending through said ground plane and dielectric substrate to said radiating element;

f. the length of said radiating element determining the resonant frequency of said antenna;

g. the antenna input impedance being variable to match most practical impedances as said feed point is moved along said centerline between the antenna radiating element center point and the end of the radiating element in either direction without affecting the antenna radiation pattern;

h. the antenna bandwidth being variable with the width of the radiating element and the spacing between said radiating element and said ground plane, said spacing between the radiating element and the ground plane having somewhat greater effect on the bandwidth than the element width.

2. An antenna as in claim 1 wherein the ground plane conductor extends at least one wavelength beyond each edge of the radiating element to minimize any possible backlobe radiation.

3. An antenna as in claim 1 wherein said thin rectangular radiating element is in the form of a square, said square element being the limit as to how wide the element can be without exciting higher order modes of radiation.

4. An antenna as in claim 1 wherein a plurality of said radiating elements are arrayed to provide a near isotropic radiation pattern.

5. An antenna as in claim 1 wherein the length of said radiating element is approximately ½ wavelength.

6. An antenna as in claim 1 wherein said antenna operates to receive and radiate electromagnetic energy in the 1435–1535 MHz and the 2200–2290 MHz bands.

7. An antenna as in claim 1 wherein said thin rectangular radiating element being formed on one surface of said dielectric substrate.

8. An antenna as in claim 1 wherein the length of the antenna radiating element is determined by the equation:

$$A = [1.18 \times 10^{10} - F \times 4 \times H \times \sqrt{\epsilon}]/[2 \times F \times \sqrt{1 + 0.61 \times (\epsilon - 1) \times (B/H)^{0.1155}}]$$

where $A$ is the length to be determined $F$ = the center frequency (Hz)

$B$ = the width of the antenna element $H$ = the thickness of the dielectric $\epsilon$ = the dielectric constant of the substrate.

9. An antenna as in claim 1 wherein the radiation patterns are power patterns, $|E_\theta|^2$ and $|E_\phi|^2$, polarization field $E_\phi$ and the field normal to the polarization field $E_\theta$, and are given by the equations:

$$|E_\varphi|^2 = \frac{I_m^2 Z_o^2}{4\lambda^2 r^2}[U \times \cos\phi + T \times \sin\theta]^2$$

and $$|E_\theta|^2 = \frac{I_m^2 Z_o^2}{4\lambda^2 r^2}[U \times \sin\phi \cos\theta]^2$$

where $U = (U2 - U3)/U5$ $T = (T3 - T4)/T8$ $U2 = P \sin (A \times P/2) \cos (k \times A \times \sin\theta \sin\phi/2)$ $U3 = k \sin\theta \sin\phi \cos (A \times P/2) \sin (k \times A \times \sin\theta \sin\phi/2)$ $U5 = (P^2 - k^2 \sin^2\theta \sin^2\phi)$ $T3 = P \sin (P \times B/2) \cos (k \times B \times \cos\theta/2)$ $T4 = k \cos\theta \cos (P \times B/2) \sin (k \times B \times \cos\theta/2)$ $T8 = (P^2 - k^2 \cos^2\theta)$ $I_m$ = maximum current (amps)

$$P = \frac{2\pi}{\lambda_g},\ k = \frac{2\pi}{\lambda}$$

$\lambda$ = free space wave length (inches)

$\lambda_g$ = waveguide wavelength (inches) and $\lambda_g = 2 \times A + (4 \times H/\sqrt{\epsilon})$ $r$ = the range between the antenna and an arbitrary point in space (inches)

$Z_0$ = characteristic impedance of the element (ohms) and $Z_0$ is given by $$Z_o = \frac{377 \times H}{\sqrt{\epsilon} \times B \times [1 + 1.735(\epsilon^{-0.0724})(H/B)^{0.836}]}$$

$H$ = the thickness of the dielectric $B$ = the width of the antenna element $\epsilon$ = the dielectric constant of the substrate (no units).

10. An antenna as in claim 1 wherein the minimum width of said radiating element is determined by the equivalent internal resistance of the conductor plus any loss due the dielectric.

11. An antenna as in claim 1 wherein the input impedance, $R_{in}$, is given by the equation $$R_{in} = \frac{2 \times Z_0^2 \times \sin^2 (2\pi\, y_0/\lambda_w)}{R_a + 2R_c}$$

where $R_a$ = the radiation resistance $2R_c$ = the total internal resistance $Z_0$ = characteristic impedance of the element, and $Y_0$ = distance of feed point from the center of the element.

* * * * *